US009260887B2

(12) United States Patent
Lambrou et al.

(10) Patent No.: US 9,260,887 B2
(45) Date of Patent: Feb. 16, 2016

(54) LOCK ASSEMBLY

(75) Inventors: Harris Lambrou, Blackburn (AU); Ian Bartos, Blackburn (AU)

(73) Assignee: GAINSBOROUGH HARDWARE INDUSTRIES LIMITED, Blackburn (AU)

( * ) Notice: Subject to any disclaimer, the term of this patent is extended or adjusted under 35 U.S.C. 154(b) by 28 days.

(21) Appl. No.: 13/980,492

(22) PCT Filed: Jan. 19, 2012

(86) PCT No.: PCT/AU2012/000038

§ 371 (c)(1),
(2), (4) Date: Jul. 18, 2013

(87) PCT Pub. No.: WO2012/097410

PCT Pub. Date: Jul. 26, 2012

(65) Prior Publication Data

US 2013/0298617 A1 Nov. 14, 2013

(30) Foreign Application Priority Data

Jan. 21, 2011 (AU) ..... 2011900196

(51) Int. Cl.
*E05B 49/00* (2006.01)
*E05B 47/06* (2006.01)
(Continued)

(52) U.S. Cl.
CPC ..... *E05B 47/0657* (2013.01); *E05B 13/004* (2013.01); *E05B 47/0673* (2013.01);
(Continued)

(58) Field of Classification Search
CPC ..... E05B 47/00012; E05B 47/0001; E05B 47/026; E05B 47/00; E05B 47/02; E05B 47/0004; E05B 47/06; E05B 47/0009; E05B 47/0673; E05B 2047/0073; E05B 2047/0076; E05B 70/7107; E05B 63/0065; E05B 63/16; E05B 13/004; Y10T 70/7062; Y10T 70/7068; Y10T 70/7102; Y10T 70/7107; Y10T 70/7113; Y10T 70/7136
USPC ..... 70/107, 467, 468, 472, 277, 70/278.1–278.3, 278.7, 279.1–283.1
See application file for complete search history.

(56) References Cited

U.S. PATENT DOCUMENTS 3,872,696 A * 3/1975 Geringer ..... 70/145
3,901,542 A * 8/1975 Salzman et al. ..... 292/144
(Continued)

FOREIGN PATENT DOCUMENTS

WO 9601355 A1 1/1996
WO WO 9601355 A1 * 1/1996 ..... E05B 47/00

OTHER PUBLICATIONS

International Search Report; PCT/AU2012/000038; Mar. 16, 2012.

*Primary Examiner* — Suzanne Barrett
*Assistant Examiner* — Morgan McClure
(74) *Attorney, Agent, or Firm* — Patterson & Sheridan, LLP

(57) ABSTRACT

A lock assembly including a lock bolt, a first hub, a first electrically powered hub locker assembly and a manually driven hub locker assembly. The lock bolt is movable between a latching position and an unlatching position. The first hub is adapted to move the lock bolt in response to movement of a first handle. The first electrically powered hub locker assembly is positionable to selectively prevent or allow movement of the lock bolt in response to torque being applied to the first handle and is configurable for fail safe operation. The manually driven hub locker assembly is positionable to selectively prevent or allow movement of the lock bolt in response to torque being applied to the first handle.

28 Claims, 6 Drawing Sheets

(51) Int. Cl.

| | |
|---|---|
| ***E05B 13/00*** | (2006.01) |
| *E05B 47/00* | (2006.01) |
| *E05B 47/02* | (2006.01) |
| *E05B 63/00* | (2006.01) |
| *E05B 63/16* | (2006.01) |

(52) U.S. Cl.

CPC ..... *E05B47/0001* (2013.01); *E05B 47/02* (2013.01); *E05B 47/026* (2013.01); *E05B 63/0065* (2013.01); *E05B 63/16* (2013.01); *E05B 2047/0073* (2013.01); *E05B 2047/0076* (2013.01); *Y10T 70/7062* (2015.04); *Y10T 70/7068* (2015.04); *Y10T 70/7107* (2015.04)

(56) References Cited

U.S. PATENT DOCUMENTS

| | | | | |
|---|---|---|---|---|
| 4,102,164 | A * | 7/1978 | Barbush | 70/241 |
| 4,429,556 | A * | 2/1984 | Kambic | 70/149 |
| 4,529,234 | A * | 7/1985 | Senften | 292/169.15 |
| 4,685,709 | A * | 8/1987 | Kambic | 292/201 |
| 4,702,095 | A * | 10/1987 | Ben-Asher | 70/279.1 |
| 4,831,851 | A * | 5/1989 | Larson | 70/303 A |
| 5,040,390 | A * | 8/1991 | Mistry et al. | 70/241 |
| 5,246,258 | A * | 9/1993 | Kerschenbaum et al. | 292/144 |
| 5,487,289 | A * | 1/1996 | Otto et al. | 70/279.1 |
| 6,223,567 | B1 * | 5/2001 | Fadul | 70/149 |
| 6,293,131 | B1 * | 9/2001 | Lemettinen et al. | 70/278.7 |
| 6,299,222 | B1 * | 10/2001 | Atmodimedjo | 292/144 |
| 6,412,318 | B1 * | 7/2002 | Shen | 70/217 |
| 6,539,755 | B1 * | 4/2003 | Bruwer et al. | 70/107 |
| 6,581,423 | B2 * | 6/2003 | Lin | 70/107 |
| 6,732,557 | B1 * | 5/2004 | Zehrung | 70/283 |
| 7,249,477 | B2 * | 7/2007 | Toloday et al. | 70/279.1 |
| 7,469,564 | B1 * | 12/2008 | Shaw | 70/283 |
| 7,516,633 | B1 * | 4/2009 | Chang | 70/472 |
| 8,079,240 | B2 * | 12/2011 | Brown et al. | 70/277 |
| 8,490,444 | B2 * | 7/2013 | Saari | 70/277 |
| 8,610,535 | B2 * | 12/2013 | Hui | 340/5.2 |
| 8,671,724 | B2 * | 3/2014 | Uyeda | 70/279.1 |
| 2003/0106357 | A1 * | 6/2003 | Keightley | 70/279.1 |
| 2005/0199026 | A1 * | 9/2005 | Geringer et al. | 70/283 |
| 2006/0144102 | A1 * | 7/2006 | Keightley | 70/279.1 |
| 2007/0245784 | A1 * | 10/2007 | Geringer et al. | 70/277 |
| 2008/0105012 | A1 * | 5/2008 | Poppell | 70/279.1 |
| 2008/0236213 | A1 * | 10/2008 | Blanch | 70/107 |
| 2009/0282876 | A1 * | 11/2009 | Zuraski et al. | 70/35 |
| 2009/0282879 | A1 * | 11/2009 | Marcelle et al. | 70/277 |
| 2009/0308118 | A1 * | 12/2009 | Antonucci | 70/277 |
| 2010/0133856 | A1 * | 6/2010 | Helisten | 292/144 |
| 2012/0291502 | A1 * | 11/2012 | Frankham et al. | 70/279.1 |
| 2014/0165677 | A1 * | 6/2014 | Hickman | 70/277 |
| 2014/0331723 | A1 * | 11/2014 | Holz | 70/278.1 |

* cited by examiner

LOCK ASSEMBLY

FIELD OF THE INVENTION

The present invention relates to a lock assembly.

The invention has been developed primarily for use with an electrically controllable and electrically powered mortice lock and will be described hereinafter with reference to this application. However, it will be appreciated that the invention is not limited to this particular use is also suitable for use in other types of locks, such as surface mounted locks.

BACKGROUND OF THE INVENTION

Electrically controllable and/or electrically powered locks are known. A disadvantage of such locks is they can not be used to lock and unlock a door when required until door control and/or monitoring electrics are installed and fully operational. Accordingly, to provide security and access control, it is common to install a second manual lock, or post a guard, until this occurs. Such measures are both inconvenient and incur cost.

Further, such locks must also be set to operate as either fail safe or fail secure. A fail safe lock automatically reverts to an unlocked state when its power supply is interrupted, for example during a power failure or a break-in attempt. A fail secure lock automatically reverts to a locked state when its power supply is interrupted. However, a fail safe or fail secure setting is not always appropriate for all uses of the lock. As an example, a disadavantage of such a lock set to fail safe is it does not allow a door to be locked whilst the door control and/or monitoring electrics are not yet installed or fully operational. Another disadvantage of such locks is that security and access control can be lost when the control of the lock, which can be located remotely, has been compromised.

OBJECT OF THE INVENTION

It is the object of the present invention to substantially overcome or at least ameliorate the above disadvantages.

SUMMARY OF THE INVENTION

Accordingly, the present invention provides a lock assembly including:

a lock bolt movable between a latching position and an unlatching position;

a first hub adapted to move the lock bolt in response to movement of a first handle;

a first electrically powered hub locker assembly positionable to selectively prevent or allow movement of the lock bolt in response to torque being applied to the first handle, the first electrically powered hub locker assembly configurable for fail safe operation; and a manually driven hub locker assembly positionable to selectively prevent or allow movement of the lock bolt in response to torque being applied to the first handle.

The first electrically powered hub locker assembly and the manually driven hub locker assembly are preferably positionable independently of one another.

In one form, the first electrically powered hub locker and the manually driven hub locker assembly share some common componentry. In another form, the first electrically powered hub locker and the manually driven hub locker assembly share no common componentry.

The first electrically powered hub locker assembly is preferably also configurable for fail secure operation.

The manually driven hub locker assembly is preferably driven by a key or a turn button.

The lock assembly preferably includes a housing, and the lock bolt, the first hub, the first electrically powered hub locker assembly and the manually driven hub locker assembly are mounted in the housing.

The first hub preferably includes:

a first part, adapted to engage with, or abut, the first electrically powered hub locker assembly so as to prevent movement of the lock bolt in response to torque being applied to the first handle; and a second part, adapted to engage with, or abut, the manually driven hub locker assembly so as to prevent movement of the lock bolt in response to torque being applied to the first handle.

The manually driven hub locker assembly is preferably adapted for selective removal of a power and/or control signal to the first electrically powered hub locker assembly.

The lock assembly preferably includes a first controller between a power and for control signal supply and the first electrically powered hub locker assembly, wherein the manually driven hub locker assembly is adapted for altering the first controller from a first configuration, allowing power and/or control signals to be transmitted from the power and/or control signal supply to the first electrically powered hub locker assembly, to a second configuration preventing power and/or control signals from being transmitted from the power and/or control signal supply to the first electrically powered hub locker assembly.

The lock assembly preferably includes a first switch between a power and for control signal supply and the first electrically powered hub locker assembly, wherein the first switch is manually settable in a first configuration, allowing power and/or control signals to be transmitted from the power and/or control signal supply to the first electrically powered hub locker assembly, or in a second configuration preventing power and/or control signals from being transmitted from the power and/or control signal supply to the first electrically powered hub locker assembly.

The lock assembly preferably also includes:

a second hub adapted to move the lock bolt in response to movement of a second handle; and a second electrically powered hub locker assembly positionable to selectively prevent or allow movement of the lock bolt in response to torque being applied to the second handle, the second electrically powered hub locker assembly configurable for fail safe operation, wherein the manually driven hub locker assembly is positionable to selectively prevent or allow movement of the lock bolt in response to torque being applied to the second handle and the second electrically powered hub locker assembly and the manually driven hub locker assembly are operable independently of one another.

In one form, the manually driven hub locker assembly includes a locking bar adapted for operative interaction with both the first hub and the second hub. In another form, the manually driven hub locker assembly includes a first locking bar and a second locking bar, each adapted for operative interaction with the first hub and the second hub respectively.

The second electrically powered hub locker assembly is preferably also configurable for fail secure operation.

The second hub and the second electrically powered hub locker assembly are preferably also mounted in the housing.

The second hub preferably includes:

a first part, adapted to engage with, or abut, the second electrically powered hub locker assembly so as to prevent movement of the lock bolt in response to torque being applied to the second handle; and a second part, adapted to engage with, or abut, the manually driven hub locker assembly so as to prevent movement of the lock bolt in response to torque being applied to the second handle.

The first manually driven hub locker assembly is preferably adapted for selective removal of a power and/or control signal to the second electrically powered hub locker assembly.

The lock assembly preferably includes a second controller between a power and for control signal supply and the second electrically powered hub locker assembly, wherein the manually driven hub locker assembly is adapted for altering the second controller from a first configuration, allowing power and/or control signals to be transmitted from the power and/or control signal supply supply to the second electrically powered hub locker assembly, to a second configuration preventing power and/or control signals from being transmitted from the power and/or control signal supply supply to the second electrically powered hub locker assembly.

The lock assembly preferably includes a second switch between a power and/or control signal supply and the second electrically powered hub locker assembly, wherein the second switch is manually settable in a first configuration, allowing power and/or control signals to be transmitted from the power and/or control signal supply to the second electrically powered hub locker assembly, or in a second configuration preventing power and/or control signals from being transmitted from the power and/or control signal supply to the second electrically powered hub locker assembly.

The lock assembly preferably includes a switch assembly incorporating the first switch and the second switch.

BRIEF DESCRIPTION OF THE DRAWINGS

A preferred embodiment of the invention will now be described, by way of an example only, with reference to the accompanying drawings in which.

DETAILED DESCRIPTION OF THE PREFERRED EMBODIMENT

Figure 1:
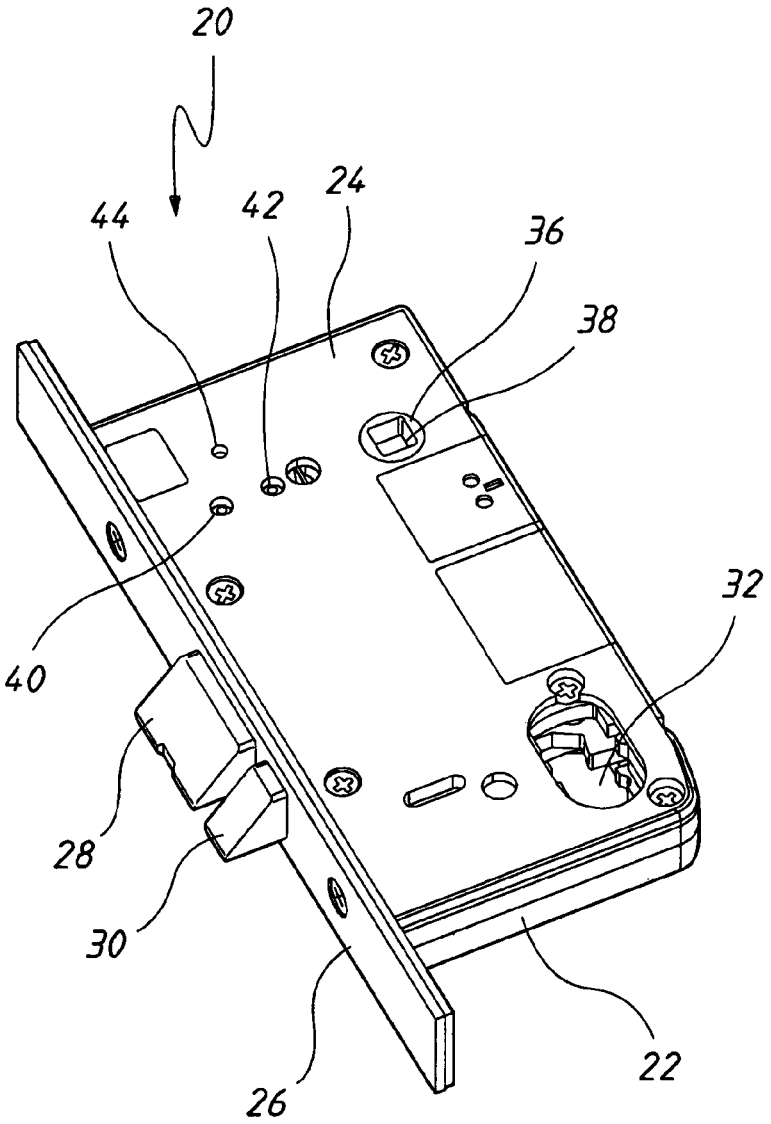
FIG. 1 is a perspective view of an embodiment of a lock assembly.

FIG. 1 shows an embodiment of an electrically controllable and electrically powered mortice lock assembly 20. The lock assembly includes a housing 22 with a side cover 24 and a face plate 26. The lock assembly 20 is installed in a door with the housing 22 within a mortice void in the door and the face plate 26 adjacent to the non-hinged edge of the door, as is well understood by persons skilled in the art. A latch bolt 28 and an auxiliary bolt 30 pass through the face plate 26 for engagement with a strike plate (not shown) in a door jamb, as is also well understood by persons skilled in the art.

Figure 4:
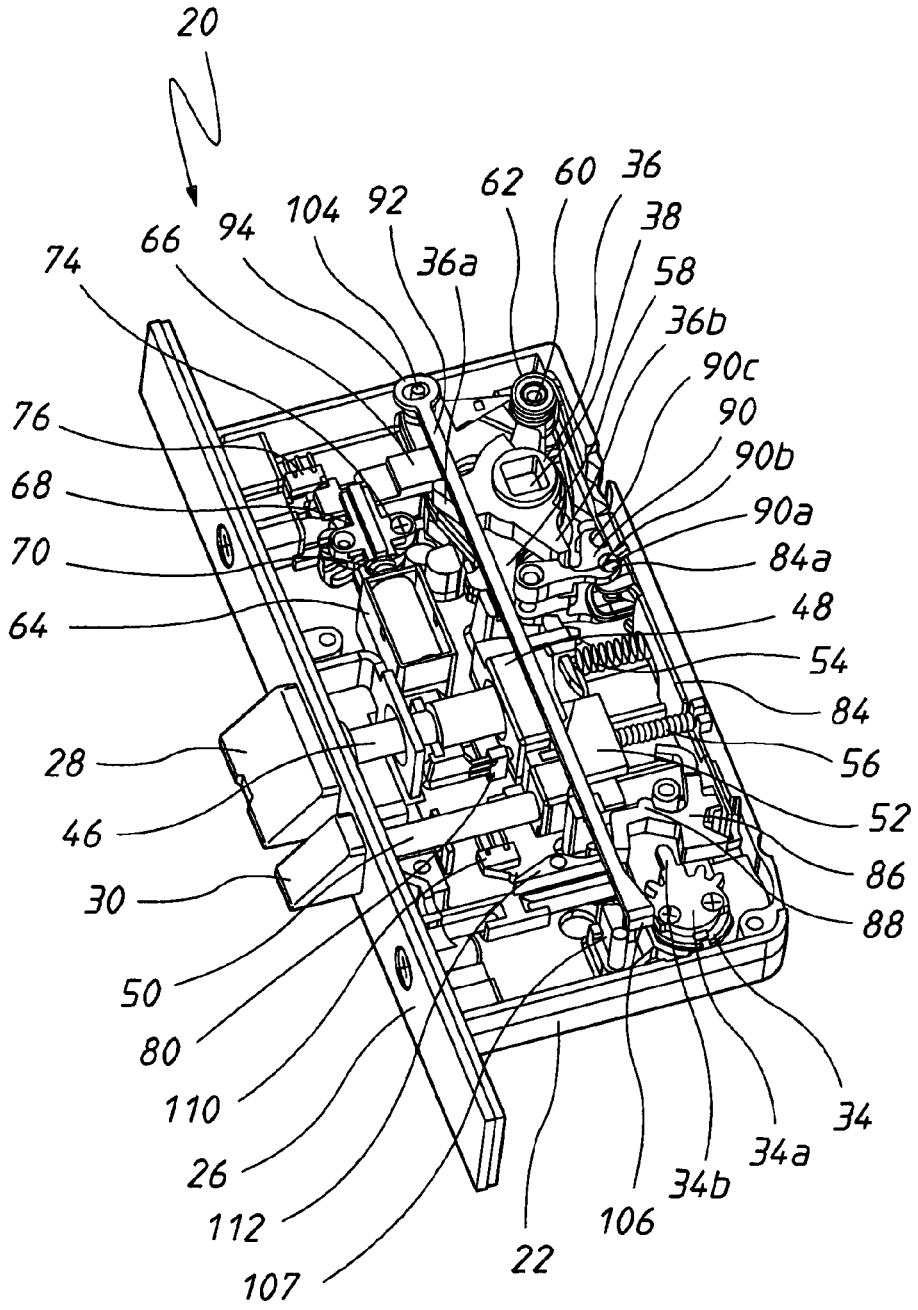
FIG. 4 shows the lock assembly of FIG. 2 with the electrically powered hub locker set to fail safe and locked and the manually powered hub locker unlocked.
Figure 5:
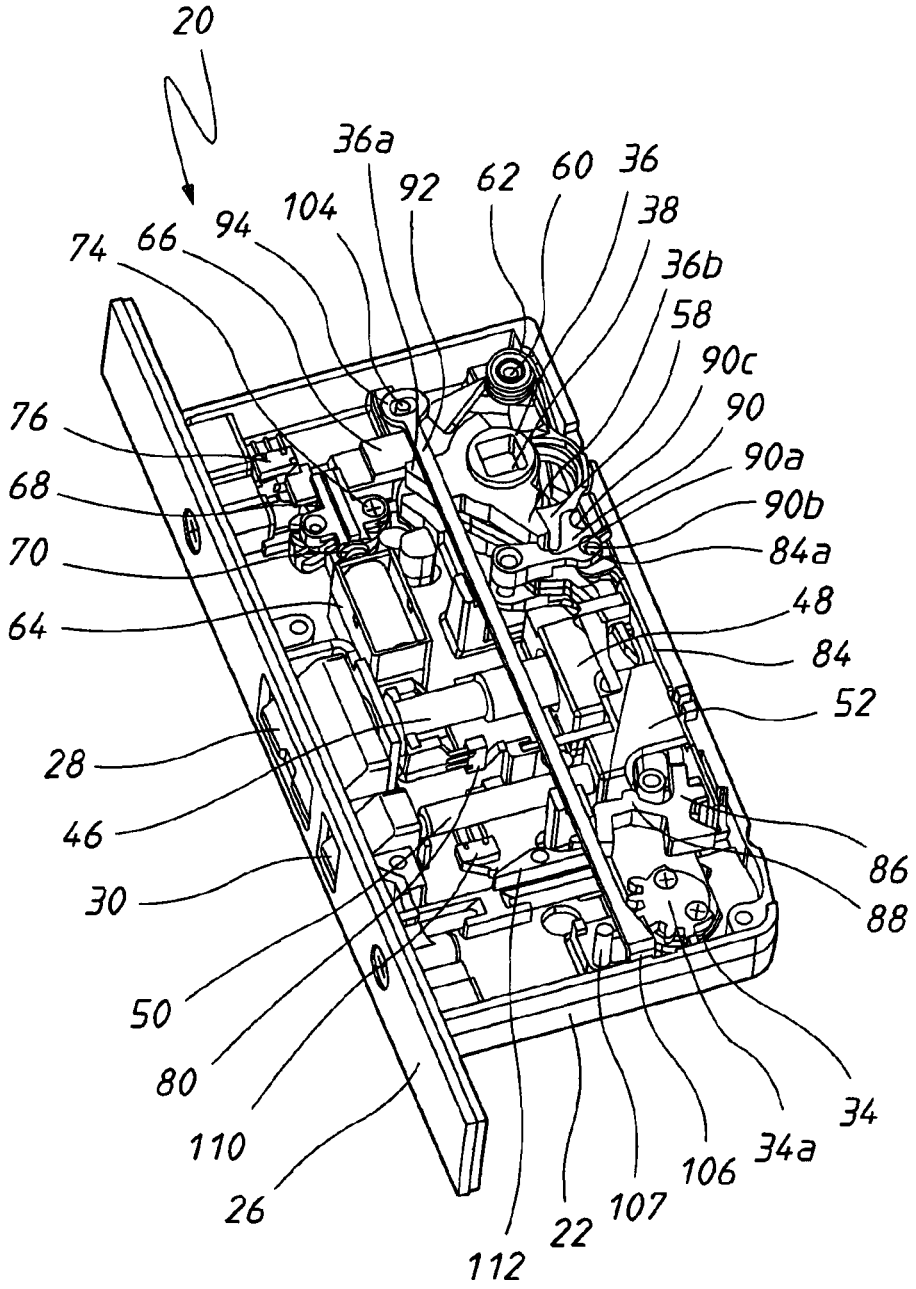
FIG. 5 shows the lock assembly of FIG. 2 with the electrically driven hub locker set to fail safe and locked and the bolts retracted via key override.
Figure 6:
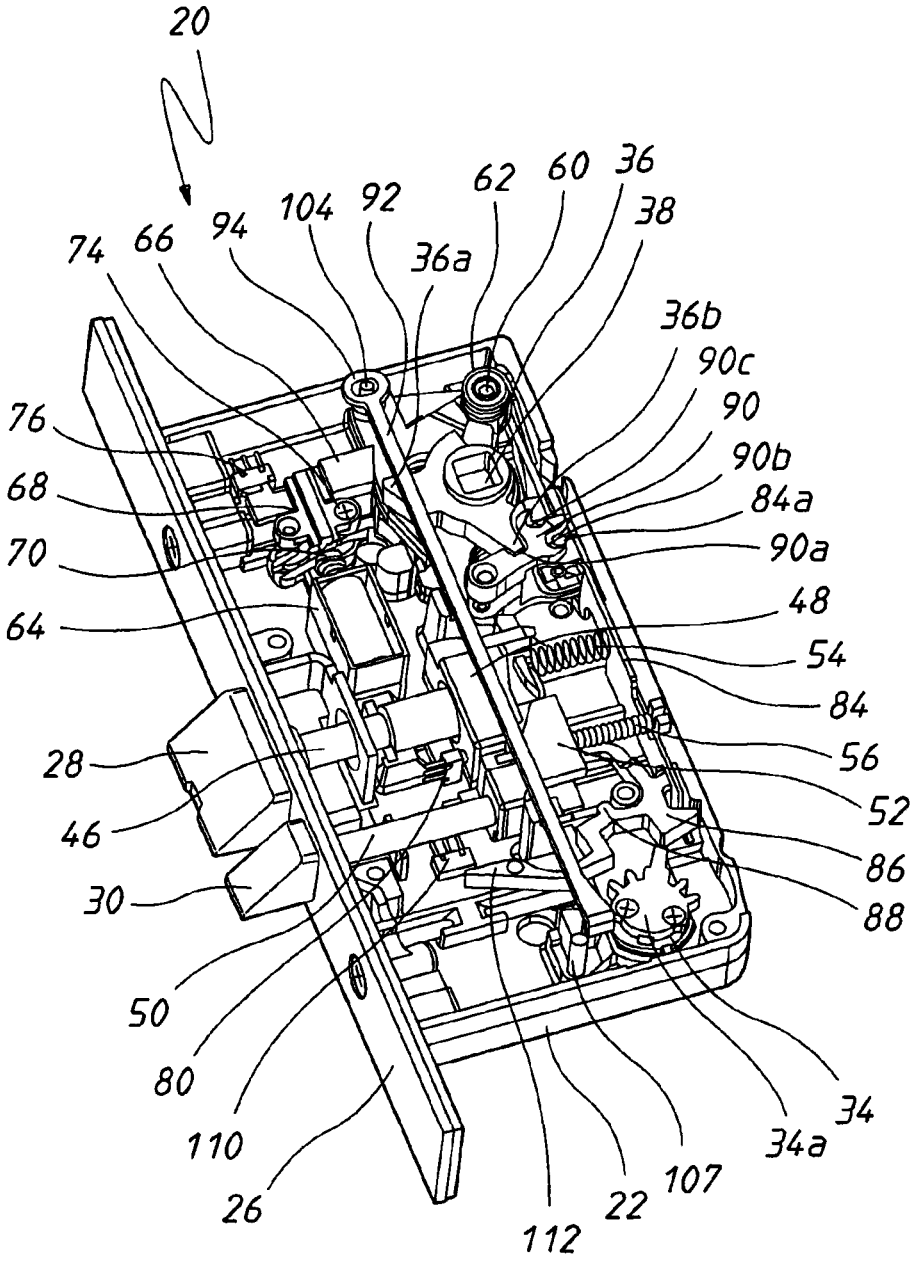
FIG. 6 shows the lock assembly of FIG. 2 with the electrically powered hub locker set to fail safe and unlocked and the manually driven hub locker locked.

The lock assembly also includes an opening 32 that receives a key cylinder assembly 34 (see FIGS. 4 to 6). The key cylinder assembly 34 includes a key clinder cam 34*a* that has a protuberance 34*b* thereon. The key cylinder assembly 34 is retained within the opening 32 with a key cylinder retaining pin (not shown), as is also well understood by persons skilled in the art. After the key cylinder assembly 34 has been inserted into the opening 32, and the key cylinder retaining pin inserted into the key cylinder assembly 34, the key cylinder retaining pin is prevented from releasing its engagement with the key cylinder 34 assembly by engagement of the faceplate 26 with the housing 22.

Figure 2:
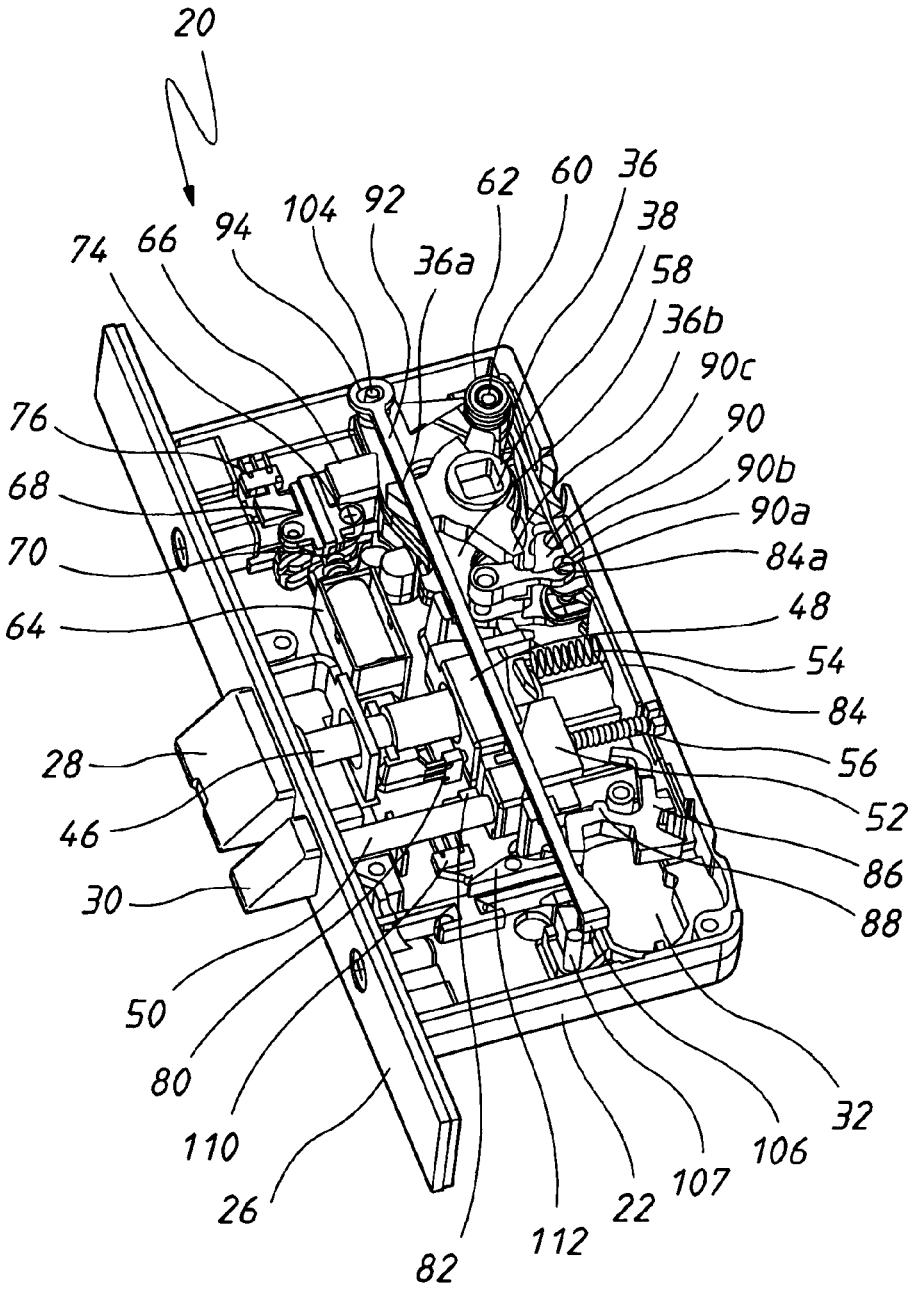
FIG. 2 is a perspective view of the lock assembly shown in FIG. 1 with a side cover removed and with an electrically powered hub locker set to fail safe and unlocked and a manually driven hub locker unlocked.

The lock assembly 20 also includes a first hub 36 with a square cross section opening 38 therein, which is adapted to engage with a square cross section drive shaft (not shown) of a first external knob lever or other handle (not shown). As shown in FIG. 2, the hub 36 includes a first part or protuberance 36*a* and a second part or protuberance 36*b*.

The side cover 24 of the lock assembly also includes a first opening 40, a second opening 42 and a third opening 44. These openings are replicated on the opposite side of the housing 22 to that shown in FIG. 1. The functions of the openings 40, 42 and 44 shall be described in more detail below in relation to setting each side of the lock assembly 20 to operate as either fail safe or fail secure.

FIG. 2 also shows the lock assembly 20 with the side cover 24 of the housing 22 removed. The latch bolt 28 is connected to a latch bolt shaft 46 which is in turn connected to a latch bolt carriage 48. The auxiliary bolt 30 is connected to an auxiliary bolt shaft 50 which is in turn connected to an auxiliary bolt carriage 52. The latch bolt 28 and the auxiliary bolt 30 are biased toward the latching position shown in FIG. 2 by a latch spring 54 and an auxiliary latch spring 56 respectively.

A carriage retraction arm 58 is pivotally mounted to the housing 22 at shaft 60 and biased toward the position shown in FIG. 2 by a spring 62. The arm 58 can be moved to retract the latch bolt 28 and the auxiliary bolt 30 under certain conditions, in response to movement of the first or second handles or the key cylinder cam 34*a*, as will be described in more detail below.

FIG. 2 also shows a first electrically powered hub locker assembly comprising a first electrically powered solenoid 64 which is connected to a first (electrically powered) hub locker 66 by a first motion transfer means 68. The first solenoid 64 is of the pull type and also includes a first biasing spring 70. The lock assembly 20 also includes a second handle, a second hub and a second electrically powered hub locker assembly on its opposite side. The second electrically powered hub locker assembly similarly comprises a second electrically powered solenoid which is connected to a second (electrically powered) hub locker by a second motion transfer means. The second electrically powered solenoid is also a pull-type and also includes a second biasing spring.

Placing a screw 74 in the first motion transfer means 68 in a position corresponding to the opening 42 sets the first electrically powered hub locker assembly to operate as fail safe. When set as fail safe, energising the first solenoid 64 places the first hub locker in a position preventing movement of the bolts 28 and 30 in response to torque being applied to the first handle. De-energising the first solenoid 64 allows the first biasing spring 70 to place the first (electrically powered) hub locker 66 in a position allowing movement of the bolts 28 and 30 in response to torque being applied to the first handle. Placing the screw 74 in the first motion transfer means 68 in a position corresponding to the opening 40 sets the first electrically powered hub locker assembly to operate as fail secure. When set as fail secure, energising the first solenoid 64 places the first (electrically powered) hub locker 66 in a position allowing movement of the bolts 28 and 30 in response to torque being applied to the first handle. De-energising the first solenoid 64 allows the first biasing spring 70 to place the first (electrically powered) hub locker 66 in a position preventing movement of the bolts 28 and 30 in response to torque being applied to the first handle. The second electrically powered hub locker assembly operates in a similar manner to the first electrically powered hub locker assembly.

The operation of the first and second electrically powered hub locker assemblies is also described in Australian patent application No. 2010903161 filed by the Applicant on 15 Jul. 2010, and International PCT patent application No. PCT/AU2011/000745 filed by the Applicant on 20 Jun. 2011, the relevant contents of which are incorporate herein by cross reference.

FIG. 2 also shows a first hub locker sensor 76 which is able to provide a signal indicative of the position of the first (electrically powered) hub locker 66 to allow remote signaling of the lock status of the first hub 36 to a remotely located controller or other internal control. A similar sensor is provided for the second (electrically powered) hub locker also. FIG. 2 also shows a latch bolt sensor 80 and an auxiliary bolt sensor 82 which similarly signal the position of the latch bolt 28 and the auxiliary bolt 30 respectively. Other sensors (not shown) can also be added as desired to other mechanical facets of the lock assembly 20 and/or to remotely signal lock and/or door status or to provide other internal control.

FIG. 2 also shows a manually driven hub locker assembly which can be positioned to prevent movement of the bolts 28 and 30 in response to torque being applied to the first handle or to allow movement of the bolts 28 and 30 in response to torque being applied to the first handle. The manually driven hub locker assembly includes a locking bar 84, a locking bar driver 86, which is adapted for pivotal movement about a shaft 88, and a first (manually driven) hub locker 90. The locking bar 84 includes a spring detent 84*a*. The first hub locker 90 includes recesses 90*a*, 90*b* and 90*c*.

When the first hub locker 90 is connected to the detent 84*a* at recess 90*b*, the locking bar 84 can be driven to position the first (manually driven) hub locker 90 in or out of engagement with the second part 36*b* of the first hub 36, as will be described in more detail below. When the first (manually driven) hub locker 90 is connected to the detent 84*a* at recess 90*c*, the first (manually driven) hub locker 90 will remain out of engagement with the second part 36*b* of the first hub 36 in all positions of the locking bar 84. A second (manually driven) hub locker (not shown) is similarly connected to the locking bar 84 for similar interaction with the second hub. Accordingly, the manually driven hub locker assembly can be configured to act on none, one or both of the first and second hubs.

FIG. 2 also shows a key cylinder retraction bar 92 which has one end 94 attached to the carriage retraction arm 58 at shaft 104 and a depending part 106 on the other end. A gear part 107, which is pivotally mounted to the housing 22, is located adjacent the depending part 106.

The manually driven hub locker assembly is very similar to that described in Australian patent application No. 2009905497 filed by the Applicant on 10 Nov. 2009 and International PCT patent application No. PCT/AU2010/001349 filed by the Applicant on 13 Oct. 2010, the relevant contents of which are incorporated herein by cross reference.

Figure 3:
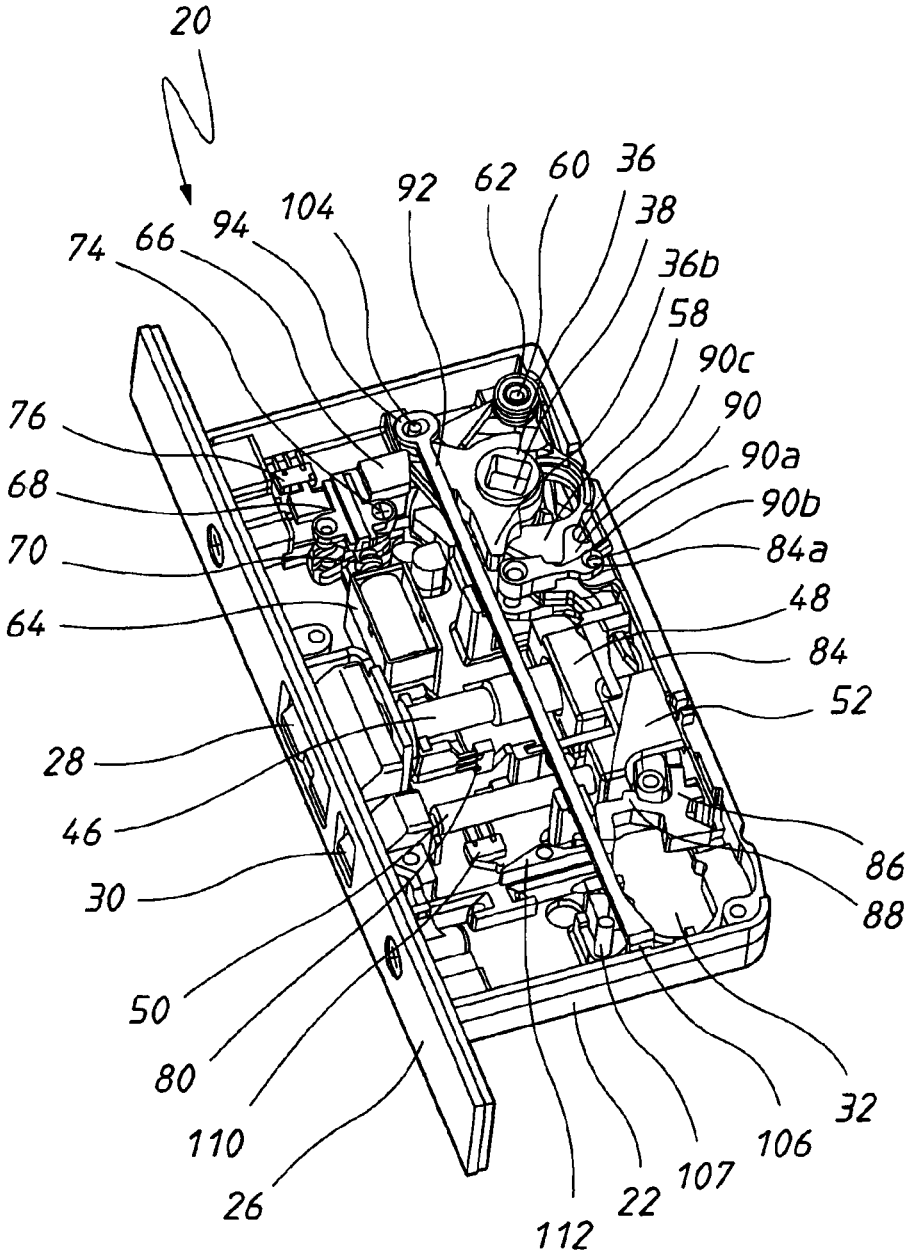
FIG. 3 shows the lock assembly of FIG. 2 with a hub rotated and bolts retracted.

The operation of the lock assembly 20 will now be described. FIG. 2 shows the first electrically powered hub locker assembly set to fail safe and unlocked. The first (electrically powered) hub locker 66 is positioned clear of abutting or engaging with the first part 36*a* of the first hub 36, thus allowing movement of the first hub 36 in response to torque being applied to the first handle. Accordingly, and as shown in FIG. 3, pivoting the first handle to pivot the first hub 36 will result in the carriage retraction arm 58 moving to withdraw the latch bolt 28 and the auxiliary latch bolt 30. In FIGS. 2 and 3, the first (manually driven) hub locker 90 is positioned so as to not engage the second part 36*b* of the first hub 36.

FIG. 4 shows the lock assembly 20 with the first electrically powered hub locker assembly positioned to prevent movement of the first hub in response to torque being applied to the first handle. In this position, the first solenoid 64 has been energized and has caused the first (electrically powered) hub locker 66 to move into the position abutting or engaging the first part 36*a* of the first hub 36, which prevents movement of the first hub 36 in response to torque being applied to the first handle. FIG. 4 also shows that the first (manually driven) hub locker 90 is positioned with the recess 90*a* not engaging the second part 36*b* of the first hub 36.

FIG. 5 shows the lock assembly 20 of FIG. 4 after the cam 34*a* of the key cylinder assembly 34 has been pivoted by a key such that the protuberance 34*b* has abutted and moved the gear part 107. The gear part 107 in turn abuts and moves the depending part 106 of the key cylinder retraction bar 92, thereby causing the other end 94 of the key cylinder retraction bar 92 to pivot the carriage retraction arm 58 and retract the bolts 28 and 30. It should be appreciated that this action, known as key override unlatching, withdraws the bolts 28 and 30 for door opening but does not unlock the lock assembly 20. Accordingly, as soon as torque is removed from the key used to pivot the cam 34*a* of the key cylinder assembly 34, the springs 54 and 56 extend the bolts 28 and 30 and return the lock assembly 20 to the locked configuration shown in FIG. 4.

FIG. 6 shows the lock assembly 20 set to fail safe and with the first electrically powered hub locker assembly positioned to allow movement of the first hub in response to torque being applied to the first handle. FIG. 6 also shows the the second part 36*b* of the hub 36 engaged with the recess 90*a* of the first (manually driven) hub locker 90. As a result, movement of the first hub 36 is prevented in response to torque being applied to the first handle and the lock assembly 20 is thus locked. The first (manually driven) hub locker 90 is moved to the position shown in FIG. 6 by pivoting the cam 34*a* of the key cylinder assembly 34 in the opposite direction to that described in relation to key override unlatching. This causes the locking bar driver 86 to pivot about the shaft 88 and thus drive the locking bar 84 away from the key cylinder assembly 34. This movement of the locking bar 84 drives the first (manually driven) hub locker 90 to the position shown, with the recess 90*a* engaging the second part 36*b* of the first hub 36 and prevent it from moving. Even though the lock assembly 20 is now locked, key overide unlatching (not unlocking) is able to be used to withdraw the bolts 28 and 30 for door opening from one side of the lock assembly (using a different cam to the cylinder cam 34*a*).

FIG. 6 also shows a switch 110 and a pivotal actuator 112. Operating the manually driven hub locker assembly as previously described causes the locking bar driver 86 to pivot which in turn pivots the bar 112 into a position actuating the switch 110. The output of the switch 110 can then be used to provide a signal (or signal absence) to a remotely located controller or monitoring system or to cause some other electrical internal change. This can allow the lock controller/monitoring system to issue an alert that the lock assembly has been manually locked and/or to trigger a removal of power to the electrical hub locker assemblies.

The positioning of the first electrically powered hub locker assembly and that of the manually driven hub locker assembly are independent of one another. The positioning of the second electrically powered hub locker assembly and that of the manually driven hub locker assembly are also independent of one another. This advantageously allows the lock assembly 20 to be set to operate as fail safe and still be able to be manually locked even when power is not available. This is particularly useful and advantageous during the fitting out of a building where the door control/monitoring electrics are not yet installed or fully operational, as security and access control is provided via the manual method of key locking the door (for example at night) and manual locking and unlocking (for example by a building crew) when working during the day.

The independent positioning of the electrically powered hub locker assemblies and the manually driven hub locker assembly also provides the opportunity to manually lock a lock assembly set to operate as fail secure. This ensures the lock assembly remains locked when power is restored. This is useful and advantageous for establishing manual/key security when control of the electrically powered hub locker assemblies has been compromised. In this connection, it should be appreciated that a control system for a building's locks can be located remotely from the building, including in another country.

As a further advantage, the independently operable electrically powered hub locker assemblies and the manually driven hub locker assembly are both able to fit within a lock housing which is of a sufficiently small size so as to be attractive to purchasers. This avoids the situation of a user having to purchase and install two different locks on a door to achieve the same functionality.

Although the invention has been described with reference to a preferred embodiment, it will be appreciated by persons skilled in the art that the invention can be embodied in many other forms. For example, in some installations, the key cylinder is replaced by a turn button. In another embodiment (not shown), the first and second (manually driven) hub lockers are each associated with a respective, independently positionable, first and second locking bars and first and second locking bar drivers. The lock assembly can also include one or more switches between the power and/or control signal supply and the electrically powered hub locker assemblies. Such switches allow none, one or both of the electrically powered hub locker assemblies to be disabled. This is useful and advantageous for establishing manual/key security when control of the electrically powered hub locker assemblies has been compromised.

The invention claimed is:

1. A lock assembly including:

a lock bolt movable between a latching position and an unlatching position;

a first hub adapted to move the lock bolt in response to movement of a first handle;

a first electrically powered hub locker assembly positionable to selectively prevent or allow movement of the lock bolt in response to torque being applied to the first handle, the first electrically powered hub locker assembly configurable for fail safe operation; and a manually driven hub locker assembly positionable to selectively prevent or allow movement of the lock bolt in response to torque being applied to the first handle, wherein the first electrically powered hub locker assembly and the manually driven hub locker assembly are positionable independently of one another, and wherein the first hub includes:

a first part, adapted to engage with, or abut, the first electrically powered hub locker assembly so as to prevent movement of the lock bolt in response to torque being applied to the first handle; and a second part, adapted to engage with, or abut, the manually driven hub locker assembly so as to prevent movement of the lock bolt in response to torque being applied to the first handle.

2. The lock assembly as claimed in claim 1, wherein the first electrically powered hub locker and the manually driven hub locker assembly share some common componentry.

3. The lock assembly as claimed in claim 1, wherein the first electrically powered hub locker assembly is also configurable for fail secure operation.

4. The lock assembly as claimed in claim 1, wherein the manually driven hub locker assembly is driven by a key or a turn button.

5. The lock assembly as claimed in claim 1, wherein the lock assembly includes a housing, and the lock bolt, the first hub, the first electrically powered hub locker assembly and the manually driven hub locker assembly are mounted in the housing.

6. The lock assembly as claimed in claim 1, wherein the manually driven hub locker assembly is adapted for selective removal of a power and/or control signal to the first electrically powered hub locker assembly.

7. The lock assembly as claimed in claim 1, wherein the lock assembly includes a first controller between a power and/or control signal supply and the first electrically powered hub locker assembly, wherein the manually driven hub locker assembly is adapted for altering the first controller from a first configuration, allowing power and/or control signals to be transmitted from the power and/or control signal supply to the first electrically powered hub locker assembly, to a second configuration preventing power and/or control signals from being transmitted from the power and/or control signal supply to the first electrically powered hub locker assembly.

8. The lock assembly as claimed in claim 1, wherein the lock assembly includes a first switch between a power and/or control signal supply and the first electrically powered hub locker assembly, wherein the first switch is manually settable in a first configuration, allowing power and/or control signals to be transmitted from the power and/or control signal supply to the first electrically powered hub locker assembly, or in a second configuration preventing power and/or control signals from being transmitted from the power and/or control signal supply to the first electrically powered hub locker assembly.

9. The lock assembly as claimed in claim 1, wherein the lock assembly also includes: a second hub adapted to move the lock bolt in response to movement of a second handle; and a second electrically powered hub locker assembly positionable to selectively prevent or allow movement of the lock bolt in response to torque being applied to the second handle, the second electrically powered hub locker assembly configurable for fail safe operation, wherein the manually driven hub locker assembly is positionable to selectively prevent or allow movement of the lock bolt in response to torque being applied to the second handle and the second electrically powered hub locker assembly and the manually driven hub locker assembly are operable independently of one another.

10. The lock assembly as claimed in claim 9, wherein the manually driven hub locker assembly includes a locking bar adapted for operative interaction with both the first hub and the second hub.

11. The lock assembly as claimed in claim 9, wherein the manually driven hub locker assembly includes a first locking bar and a second locking bar, each adapted for operative interaction with the first hub and the second hub respectively.

12. The lock assembly as claimed in claim 9, wherein the second electrically powered hub locker assembly is also configurable for fail secure operation.

13. The lock assembly as claimed in claim 9, wherein the second hub and the second electrically powered hub locker assembly are also mounted in the housing.

14. The lock assembly as claimed in claim 9, wherein the second hub includes: a first part, adapted to engage with, or abut, the second electrically powered hub locker assembly so as to prevent movement of the lock bolt in response to torque being applied to the second handle; and a second part, adapted to engage with, or abut, the manually driven hub locker assembly so as to prevent movement of the lock bolt in response to torque being applied to the second handle.

15. The lock assembly as claimed in claim 9, wherein the first manually driven hub locker assembly is adapted for selective removal of a power and/or control signal to the second electrically powered hub locker assembly.

16. The lock assembly as claimed in claim 9, wherein the lock assembly includes a second controller between a power and/or control signal supply and the second electrically powered hub locker assembly, wherein the manually driven hub locker assembly is adapted for altering the second controller from a first configuration, allowing power and/or control signals to be transmitted from the power and/or control signal supply to the second electrically powered hub locker assembly, to a second configuration preventing power and/or control signals from being transmitted from the power and/or control signal supply to the second electrically powered hub locker assembly.

17. The lock assembly as claimed in claim 9, wherein the lock assembly includes a second switch between a power and/or control signal supply and the second electrically powered hub locker assembly, wherein the second switch is manually settable in a first configuration, allowing power and/or control signals to be transmitted from the power and/or control signal supply to the second electrically powered hub locker assembly, or in a second configuration preventing power and/or control signals from being transmitted from the power and/or control signal supply to the second electrically powered hub locker assembly.

18. The lock assembly as claimed in claim 17, wherein the lock assembly includes a switch assembly incorporating the first switch and the second switch.

19. A lock assembly including:

a lock bolt movable between a latching position and an unlatching position;

a first hub adapted to move the lock bolt in response to movement of a first handle;

a first electrically powered hub locker assembly positionable to selectively prevent or allow movement of the lock bolt in response to torque being applied to the first handle, the first electrically powered hub locker assembly configurable for fail safe operation; and a manually driven hub locker assembly positionable to selectively prevent or allow movement of the lock bolt in response to torque being applied to the first handle, wherein the first electrically powered hub locker assembly and the manually driven hub locker assembly are positionable independently of one another, and wherein the lock assembly also includes: a second hub adapted to move the lock bolt in response to movement of a second handle; and a second electrically powered hub locker assembly positionable to selectively prevent or allow movement of the lock bolt in response to torque being applied to the second handle, the second electrically powered hub locker assembly configurable for fail safe operation, wherein the manually driven hub locker assembly is positionable to selectively prevent or allow movement of the lock bolt in response to torque being applied to the second handle and the second electrically powered hub locker assembly and the manually driven hub locker assembly are operable independently of one another.

20. The lock assembly as claimed in claim 19, wherein the manually driven hub locker assembly includes a locking bar adapted for operative interaction with both the first hub and the second hub.

21. The lock assembly as claimed in claim 19, wherein the manually driven hub locker assembly includes a first locking bar and a second locking bar, each adapted for operative interaction with the first hub and the second hub respectively.

22. The lock assembly as claimed in claim 19, wherein the second electrically powered hub locker assembly is also configurable for fail secure operation.

23. The lock assembly as claimed in claim 19, wherein the second hub and the second electrically powered hub locker assembly are also mounted in the housing.

24. The lock assembly as claimed in claim 19, wherein the second hub includes: a first part, adapted to engage with, or abut, the second electrically powered hub locker assembly so as to prevent movement of the lock bolt in response to torque being applied to the second handle; and a second part, adapted to engage with, or abut, the manually driven hub locker assembly so as to prevent movement of the lock bolt in response to torque being applied to the second handle.

25. The lock assembly as claimed in claim 19, wherein the first manually driven hub locker assembly is adapted for selective removal of a power and/or control signal to the second electrically powered hub locker assembly.

26. The lock assembly as claimed in claim 19, wherein the lock assembly includes a second controller between a power and/or control signal supply and the second electrically powered hub locker assembly, wherein the manually driven hub locker assembly is adapted for altering the second controller from a first configuration, allowing power and/or control signals to be transmitted from the power and/or control signal supply to the second electrically powered hub locker assembly, to a second configuration preventing power and/or control signals from being transmitted from the power and/or control signal supply to the second electrically powered hub locker assembly.

27. The lock assembly as claimed in claim 19, wherein the lock assembly includes a second switch between a power and/or control signal supply and the second electrically powered hub locker assembly, wherein the second switch is manually settable in a first configuration, allowing power and/or control signals to be transmitted from the power and/or control signal supply to the second electrically powered hub locker assembly, or in a second configuration preventing power and/or control signals from being transmitted from the power and/or control signal supply to the second electrically powered hub locker assembly.

28. The lock assembly as claimed in claim 27, wherein the lock assembly includes a switch assembly incorporating the first switch and the second switch.

* * * * *